US005904398A

United States Patent [19]

Farricielli

[11] Patent Number: 5,904,398

[45] Date of Patent: May 18, 1999

[54] ERGONOMICALLY DESIGNED SEAT ASSEMBLY FOR A PORTABLE WHEELCHAIR

[76] Inventor: Susan Farricielli, 81 Main St., #32, Branford, Conn. 06405

[21] Appl. No.: 08/956,754

[22] Filed: Oct. 23, 1997

[51] Int. Cl.[6] ..... A47C 1/02; A61G 5/10

[52] U.S. Cl. ..... 297/313; 297/296; 297/423.28; 297/383; 297/378.12; 297/DIG. 4

[58] Field of Search ..... 297/313, 296–298, 297/337, 423.3, 423.28, 423.33, 452.46, 378.12, 383, DIG. 4

[56] References Cited

U.S. PATENT DOCUMENTS

| | | | |
|---|---|---|---|
| D. 183,233 | 7/1958 | Ahrens | 297/452.46 X |
| 288,608 | 11/1883 | Bate | 297/313 |
| 521,463 | 6/1894 | Smith-Fraser . | |
| 901,090 | 10/1908 | Frey | 297/423.28 X |
| 960,607 | 6/1910 | Wersel, Jr. | 297/293 |
| 1,689,024 | 10/1928 | Hamilton et al. | 297/423.33 |
| 1,739,260 | 12/1929 | Roe . | |
| 2,716,775 | 9/1955 | Kenimer | 297/378.12 X |
| 2,753,919 | 7/1956 | Sill . | |
| 3,823,980 | 7/1974 | Harnich | 297/452.46 X |
| 3,881,773 | 5/1975 | Rodaway . | |
| 3,917,312 | 11/1975 | Rodaway . | |
| 3,989,297 | 11/1976 | Kerstholt | 297/337 X |
| 4,125,269 | 11/1978 | Kiel . | |
| 4,593,929 | 6/1986 | Williams . | |
| 4,617,919 | 10/1986 | Suhre . | |
| 4,641,848 | 2/1987 | Ayers . | |
| 4,654,904 | 4/1987 | Britz . | |
| 4,679,816 | 7/1987 | Riikonen . | |
| 4,763,951 | 8/1988 | Silverman . | |
| 4,819,286 | 4/1989 | Beauchamp . | |
| 5,035,467 | 7/1991 | Axelson et al. . | |
| 5,101,811 | 4/1992 | Brunswick . | |
| 5,102,195 | 4/1992 | Axelson et al. . | |
| 5,127,709 | 7/1992 | Rubinstein et al. . | |
| 5,209,509 | 5/1993 | Gay et al. . | |
| 5,263,768 | 11/1993 | Scheulderman . | |
| 5,593,211 | 1/1997 | Jay et al. . | |

FOREIGN PATENT DOCUMENTS

| | | | |
|---|---|---|---|
| 41037 | 5/1981 | European Pat. Off. . | |
| 57693 | 2/1913 | Germany . | |
| 1096009 | 12/1960 | Germany | 297/293 |
| 880773 | 10/1961 | United Kingdom | 297/183.7 |
| 2203332 | 3/1997 | United Kingdom . | |

*Primary Examiner*—Peter R. Brown
*Attorney, Agent, or Firm*—St. Onge Steward Johnston & Reens LLC

[57] ABSTRACT

A wheelchair having an ergonomically designed seat assembly is provided. The seat assembly includes a backrest subassembly connected to a seat frame The backrest subassembly includes a backrest frame, at least one resilient pivotal member connected to the backrest frame, and a backrest connected to the at least one resilient pivotal member such that the backrest is capable of resilient pivotal flexing about a transverse horizontal axis. A seat is pivotally connected to the seat frame such that the seat is capable of pivotal tilting about a transverse horizontal axis relative to the seat frame and independent of the backrest subassembly. At least one resilient member is disposed between the seat frame and the seat so as to allow resilient relative pivotal tilting therebetween. Two leg rests are pivotally connected to the seat frame such that the leg rests are capable of pivoting about a transverse horizontal axis relative to the seat frame. The leg rests have a locking mechanism whereby the leg rests may be held in place at various angles relative to the seat frame.

10 Claims, 8 Drawing Sheets

ERGONOMICALLY DESIGNED SEAT ASSEMBLY FOR A PORTABLE WHEELCHAIR

FIELD OF THE INVENTION

The present invention relates to a seating assembly and, more particularly, to an ergonomically designed seating assembly for use with a portable wheelchair.

BACKGROUND OF THE INVENTION

The present invention is a seating assembly for a wheelchair designed to remedy many of the problems which have been associated with known wheelchair designs. Such problems include lack of provision for flexible movement by the wheelchair user and bulky leg rests which interfere with transferring the user to and from the wheelchair as well as with propelling the wheelchair with the legs.

Motion is one of the most fundamental parts of human life. Movement assists circulation, allowing nutrients to flow throughout the body. Without movement, the body would atrophy. Movement is a biological necessity in the development and maintenance of all human systems. From the standpoint of a wheelchair user, movement is also necessary for comfort. Sitting in the same position for hours or even minutes puts tremendous amounts of pressure on certain parts of the body, most notably the spine, which can be very uncomfortable as well as injurious.

Wheelchair designs which provide for movement of the wheelchair seat relative to the frame are known in the art, as are designs which attempt to provide for the user's comfort by means of an adjustable backrest.

U.S. Pat. Nos. 521,463 to Smith-Fraser, 1,739,260 to Roe, and 3,917,312 to Rodaway all provide for a seat mounted to the frame via springs. These prior art devices do not, however, permit flexible movement by the wheelchair user. Instead, the springs in these prior art designs merely act as shock absorbers, so that a smooth ride may be attained over rough terrain.

U.S. Pat. No. 2,753,919 to Sill discloses a wheelchair design wherein the seat frame is pivotally mounted on the wheeled carriage. A resilient means is provided which pulls a footboard in contact with the ground, providing a braking mechanism. When the user desires to move, he/she leans back, raising the footboard off the ground. Movement of the user is not a goal, and is not attained.

U.S. Pat. Nos. 4,125,269 to Kiel and 4,641,848 to Ayers disclose wheelchair designs having conventional rocking mechanisms to allow the user to rock back and forth. These designs, however, do not allow the user to flexibly move his/her body and do not reduce pressure on body parts. The rocking action merely allows the seat to move relative to the frame instead of allowing for pivoting of the knee and hip joints and flexing of the spine.

Great Britain Patent No. 2,203,332 discloses a wheelchair design wherein a chair subframe is pivotally mounted on a chair frame assembly. Two springs are provided to provide resilient support, yet allow relative movement therebetween. The pivoting resilient movement is provided as a suspension system to give the user an improved "ride." As such, no provision is made for articulated flexible movement by the user or for the reduction of pressure on body parts. The seat, back, and leg supports are connected so that they all move together, without any relative movement during pivoting.

U.S. Pat. Nos. 521,463 to Smith-Fraser, 1,739,260 to Roe, and 4,125,269 to Kiel and Great Britain Patent No. 2,203,332 disclose wheelchair designs which attempt to enhance the comfort of the user by providing for a reclining backrest. In all of these designs, the backrest is pivotally mounted on the seat frame so that the backrest may be reclined relative thereto. A means is provided so that the backrest may be locked in to place in the reclined position. A disadvantage of such a design, however, is that once the backrest is locked into place, the user cannot flexibly move.

Another problem with conventional wheelchairs involves the design of the leg rests, which often interfere with transferring the wheelchair user to or from the wheelchair. In addition, some wheelchair users, especially the elderly, are encouraged to use their feet to propel themselves in their wheelchairs as a way to exercise. It is also an easier method for some to move around rather than to grab the grips on the wheels. Conventional leg rest designs for wheelchairs often make this difficult to accomplish.

Wheelchair designs with adjustable leg rests are known in the art. Illustrative of such conventional designs are U.S. Pat. No. 4,593,929 to Williams and German Patent No. 57,693. These patents provide for vertical adjustment about a horizontal axis. Such a design allows the user to raise either or both legs and to lock the leg rests in place. These designs, however, do not provide for an adjustment whereby the leg rests may be shifted out of the way of the user when entering or leaving the wheelchair, or when propelling the wheelchair with his/her feet. Williams '929 does disclose that the leg rests may be removed completely so as not to interfere with the user. This is not a desirable solution, however, because if removed the leg rests may be lost, and because the leg rests may not be removed at all or may never be replaced due to the effort involved.

U.S. Pat. No. 5,209,509 to Gay et al. discloses a wheelchair with leg rest assemblies which, in addition to being adjustable about a horizontal axis, may also swing out laterally from the front of the chair towards the sides about a vertical axis. Such a design, however, exacerbates the problems associated with propelling the wheelchair with the feet, as the leg rests would be protruding from the sides of the wheelchair making it difficult, if not impossible, to fit through doors, hallways, or in other enclosed areas.

What is desired, therefore, is an ergonomically designed kinetic seat assembly for a wheelchair which allows for flexibility of the user's body with articulation initiated at the hip and knee joints and along the spine, and which includes adjustable leg rests that may be positioned so as not to interfere with transferring the user to and from the wheelchair, or with the user propelling the wheelchair with his/her feet.

SUMMARY OF THE INVENTION

Accordingly, it is an object of the present invention is to provide a seat assembly which allows for constant movement of the user.

Another object of the present invention is to provide a seat assembly which allows for flexibility and articulation of the user's body.

A further object of the present invention is to provide a seat assembly which does not interfere with transferring the user to and from the wheelchair.

Still another object of the present invention is to provide a seat assembly which does not interfere with the wheelchair user propelling the wheelchair with his/her legs.

These and other objects of the present invention are achieved by provision of a wheelchair having an ergonomically designed seat assembly. The seat assembly includes a backrest subassembly connected to a seat frame The backrest subassembly includes a backrest frame, at least one resilient pivotal member connected to the backrest frame, and a backrest connected to the at least one resilient pivotal member such that the backrest is capable of resilient pivotal flexing about a transverse horizontal axis. A seat is pivotally connected to the seat frame such that the seat is capable of pivotal tilting about a transverse horizontal axis relative to the seat frame and independent of the backrest subassembly. At least one resilient member is disposed between the seat frame and the seat so as to allow resilient relative pivotal tilting therebetween. Two leg rests are pivotally connected to the seat frame such that the leg rests are capable of pivoting about a transverse horizontal axis relative to the seat frame. The leg rests have a locking mechanism whereby the leg rests may be held in place at various angles relative to the seat frame.

The invention and its particular features and advantages will become more apparent from the following detailed description considered with reference to the accompanying drawings.

DETAILED DESCRIPTION OF THE INVENTION

Figure 1A:
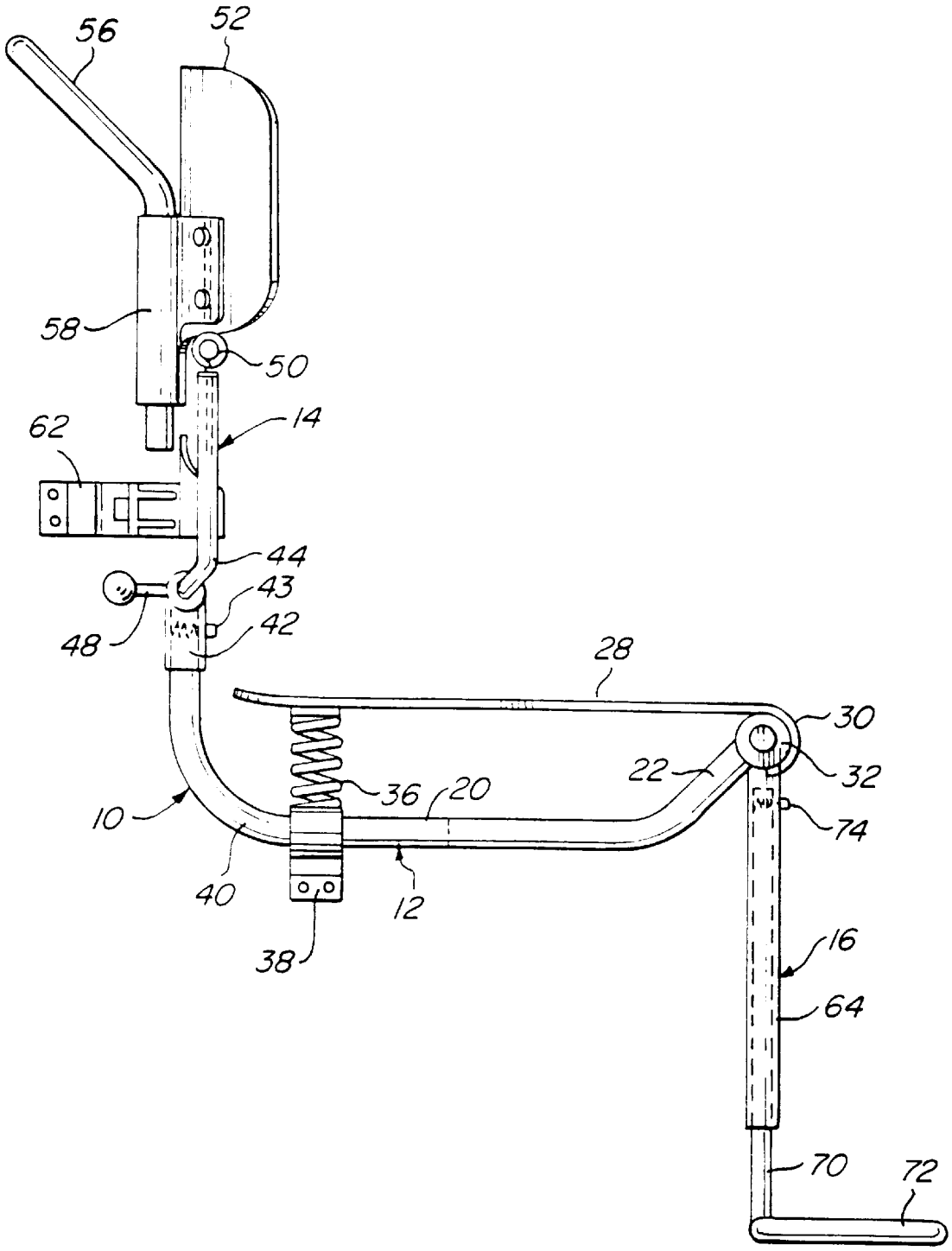
FIG. 1A is a side elevational view of a seat assembly in accordance with the invention.
Figure 2:
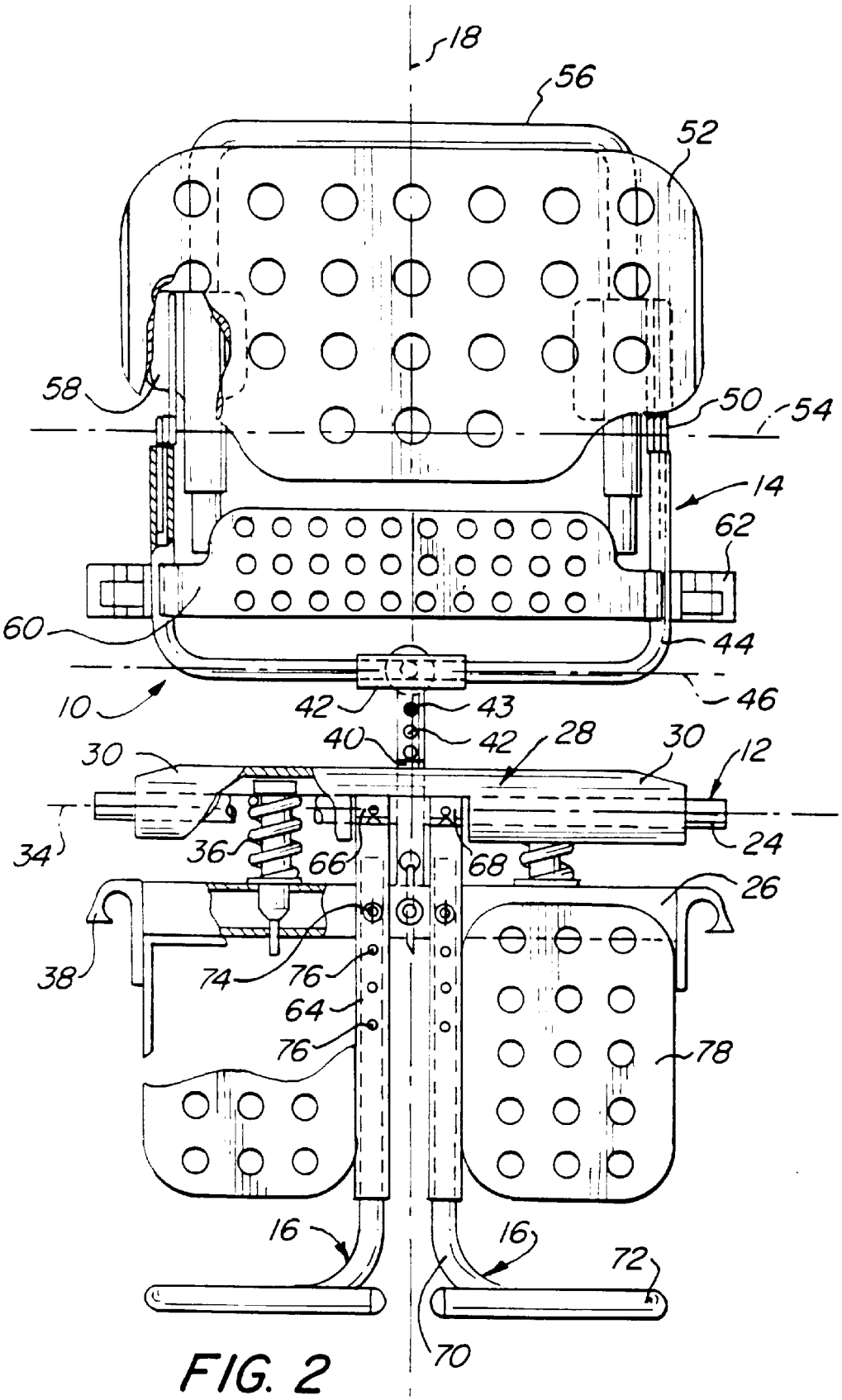
FIG. 2 is a front elevational, partially cut away, view of the seat assembly of FIG. 1A.
Figure 3:
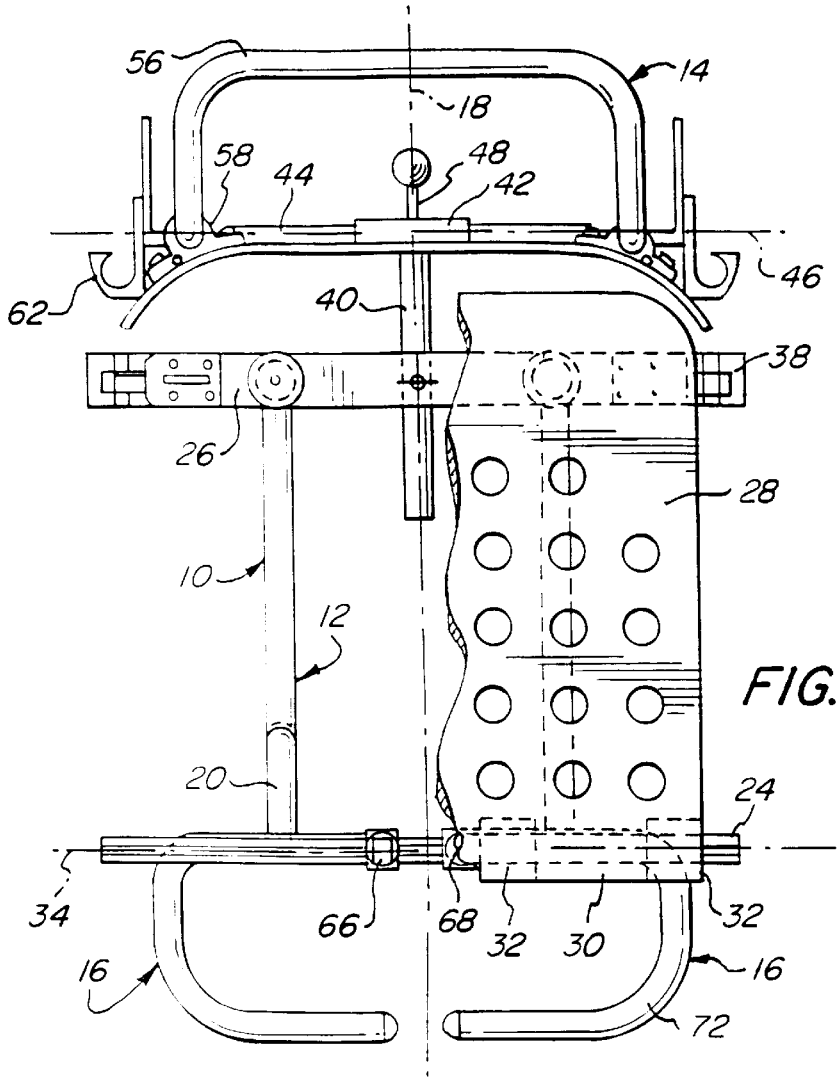
FIG. 3 is a top elevational, partially cut away, view of the seat assembly of FIG. 1A.

Referring first to FIG. 1A, 2 and 3, a seat assembly 10 in accordance with the present invention is shown. The seat assembly 10 includes a seat frame 12, a backrest subassembly 14, and two leg rests 16. The seat assembly 10 is generally symmetrical about a central vertical plane 18.

The seat frame 12 includes two generally horizontal support tubes 20, each having an end portion 22 which extends angularly upward. The end portions 22 of the support tubes 20 are connected to a tubular crosspiece 24 with the other ends of the support tubes 20 being connected to a crossbar 26. The crossbar 26 preferably has a substantially square cross section and is hollow, having a channel with a substantially square cross-section passing therethrough.

A seat 28 is provided, which has at an end thereof two sections which arc radially downward to form two mounting portions 30 having a substantially semicircular cross-section. The mounting portions 30 of the seat 28 are fit over four bearing members 32 which are disposed on the tubular crosspiece 24. The bearing members 32 are preferably standard nylon gliders, as are known in the art, but many other bearing members, such as roller bearings, are acceptable. The mounting portions 30 are attached to the outer race of the bearing members 32 by a suitable means, such as by screws or bolts (not shown). Thus, the seat 28 is attached via the bearing members 32 to the tubular crosspiece 24 of the seat frame 12 such that the seat is capable of pivoting about a transverse horizontal axis 34 relative to the seat frame 12.

Preferably the seat 28 is formed of a rigid material, such as a molded composite material, has a contoured shape ergonomically designed to correspond to the human body, and has a plurality of holes passing therethrough for ventilation. Also preferably, a seat pad (not shown) constructed from a ventilated cushioning material is disposed on said seat 28.

Figure 1B:
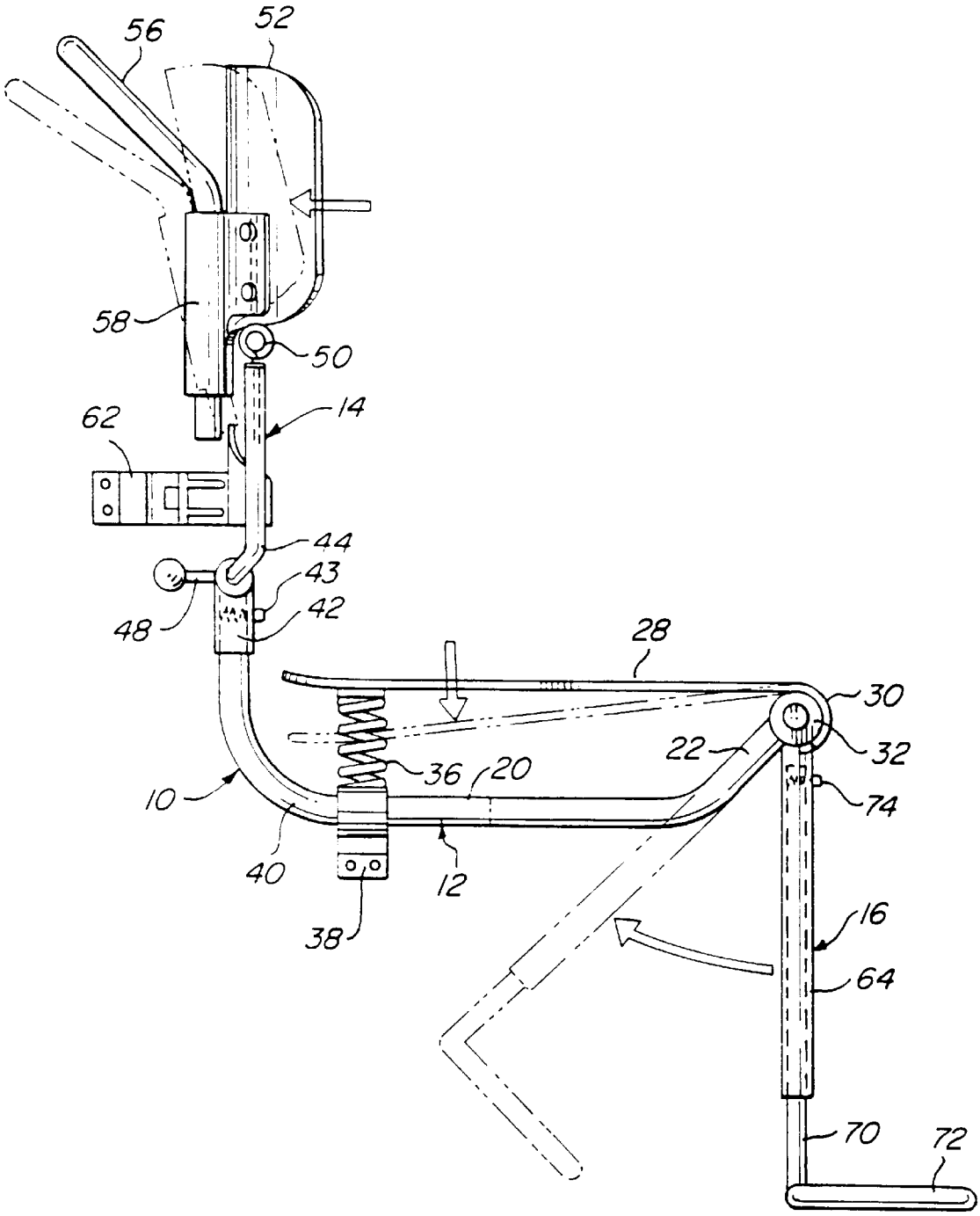
FIG. 1B is a side elevational view of the seat assembly of FIG. 1A showing, in phantom, flex of the backrest and seat and pivot of the leg rests.

Disposed between the seat 28 and the crossbar 26 of the seat frame 12 are two mechanical springs 36. The springs 36 are attached to the seat 28 and the crossbar 26 by threaded rods or bolts and nuts (not shown) passing through the center of the springs 36 and through corresponding holes in the seat 28 and the crossbar 26. The springs 36 are sized so as to normalize the seat 28 in a position substantially parallel to the support tubes 20 when no force is applied to the seat and to allow the seat 28 to pivot approximately 4 to 5 degrees from normal when a user is seated (shown in phantom in FIG. 1B). The pivotal resistance of the seat may be adjusted for users having different weights by using springs with various spring constants or by tightening or loosening the nuts on the threaded rods or nuts to provide varying initial spring resistance. The springs 36 may be encased in a bellows (not shown) to protect the springs 36 from corrosion and to protect a user from being pinched by the springs 36. An alternative to the preferred embodiment of using two mechanical springs 36 to provide pivotal resistance is to dispose two torsion springs (not shown) between the seat 28 and the seat frame 12 proximate to the tubular crosspiece 24 such that the torsion springs are compressed between the seat 28 and the seat frame 12. Thus, pivotal resistance would be supplied by the torsion springs.

Mounted on the seat frame 12 are two attachment mechanisms 38 for connecting the seat frame 12 to a chassis (not shown). The attachment mechanisms 38 are preferably typical j-hooks (shown in FIG. 2) or E-Z MOUNTS connectors manufactured by Adaptive Equipment Systems, both of which can be locked onto a tubular portion of the chassis. When E-Z MOUNTS connectors are used, adjustment in the height of the seat frame 12 relative to the chassis is possible.

Also included as part of the seat frame 12 is a backrest support 40, which is essentially a tubular member attached to the center of the crossbar 26. The backrest support 40 extends outward from the crossbar 26 and curves upward to extend past the seat 28. Preferably the backrest support 40 is attached to the crossbar 26 by passing an end of the backrest support 40 through a hole provided in the crossbar 26 and by fixing the backrest support 40 to the crossbar 26 by Allen-headed screws or locking fasteners (not shown). By providing a section of the backrest support 40 that extends past the crossbar 26, adjustment is possible in the depth of the backrest support 40, and thus the backrest subassembly 14, by loosening the Allen-headed screws or locking fasteners, adjusting the position of the backrest support 40 relative to the crossbar 26, and then tightening the screws or fasteners.

Also included as part of the seat frame 12 is a tee-shaped member 42 having a hollow channel running perpendicular to the central vertical plane 18. Extending downward from the hollow channel is a tubular sleeve portion which fits over the upwardly extending end of the backrest support 40 in a telescoping fashion. A spring loaded pin 43 is mounted within the backrest support 40. The sleeve of the tee-shaped member 42 contains a series of holes which correspond to the position of the spring loaded pin 43 such that the tee-shaped 42 member may be raised or lowered on the backrest support 40 and locked in place by the spring loaded pin 43, thus allowing the backrest subassembly 14 to be raised or lowered.

Figure 4:
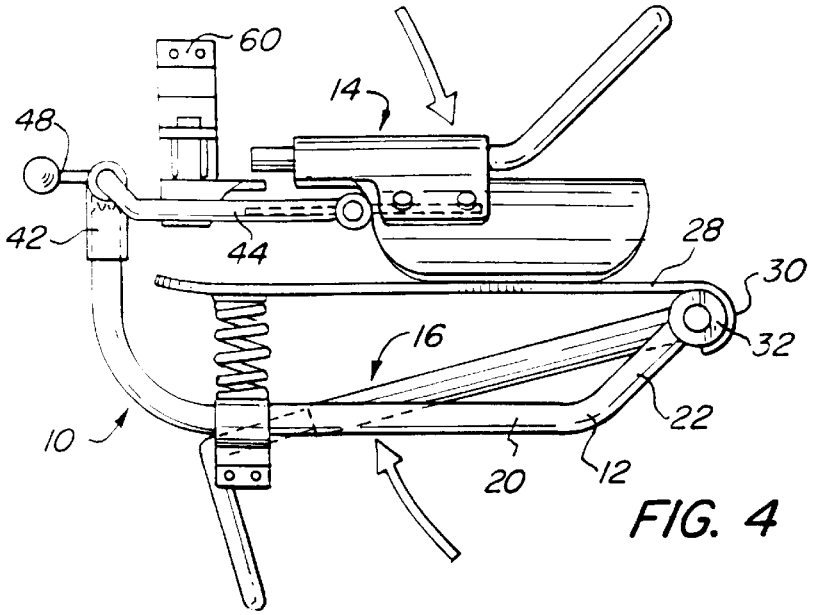
FIG. 4 is a side elevational view of the seat assembly of FIG. 1A shown in a folded position.
Figure 5:
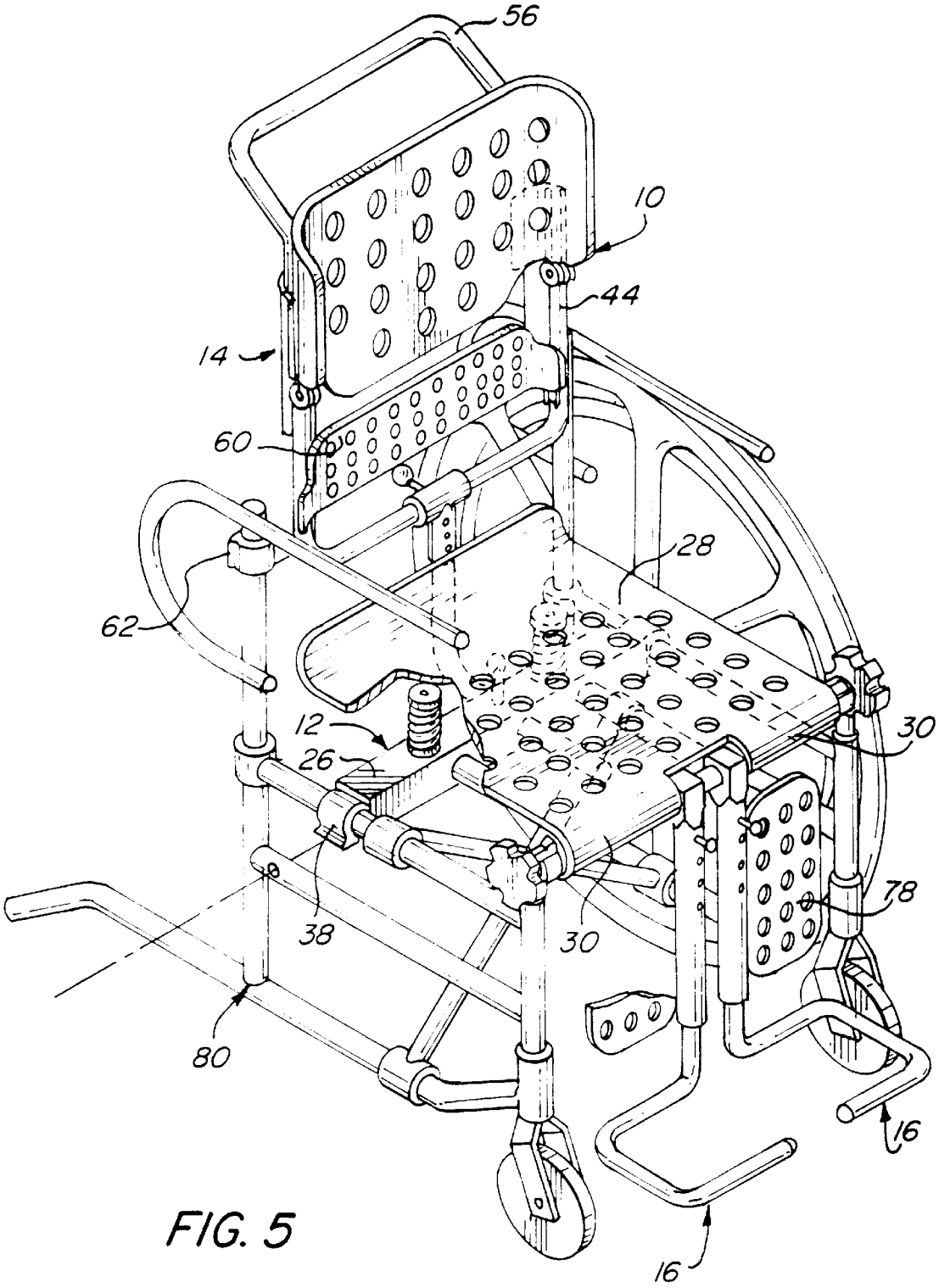
FIG. 5 is a side isometric, partially cut away, view of a wheelchair comprising the seat assembly of FIG. 1A attached to a wheelchair chassis.
Figure 6:
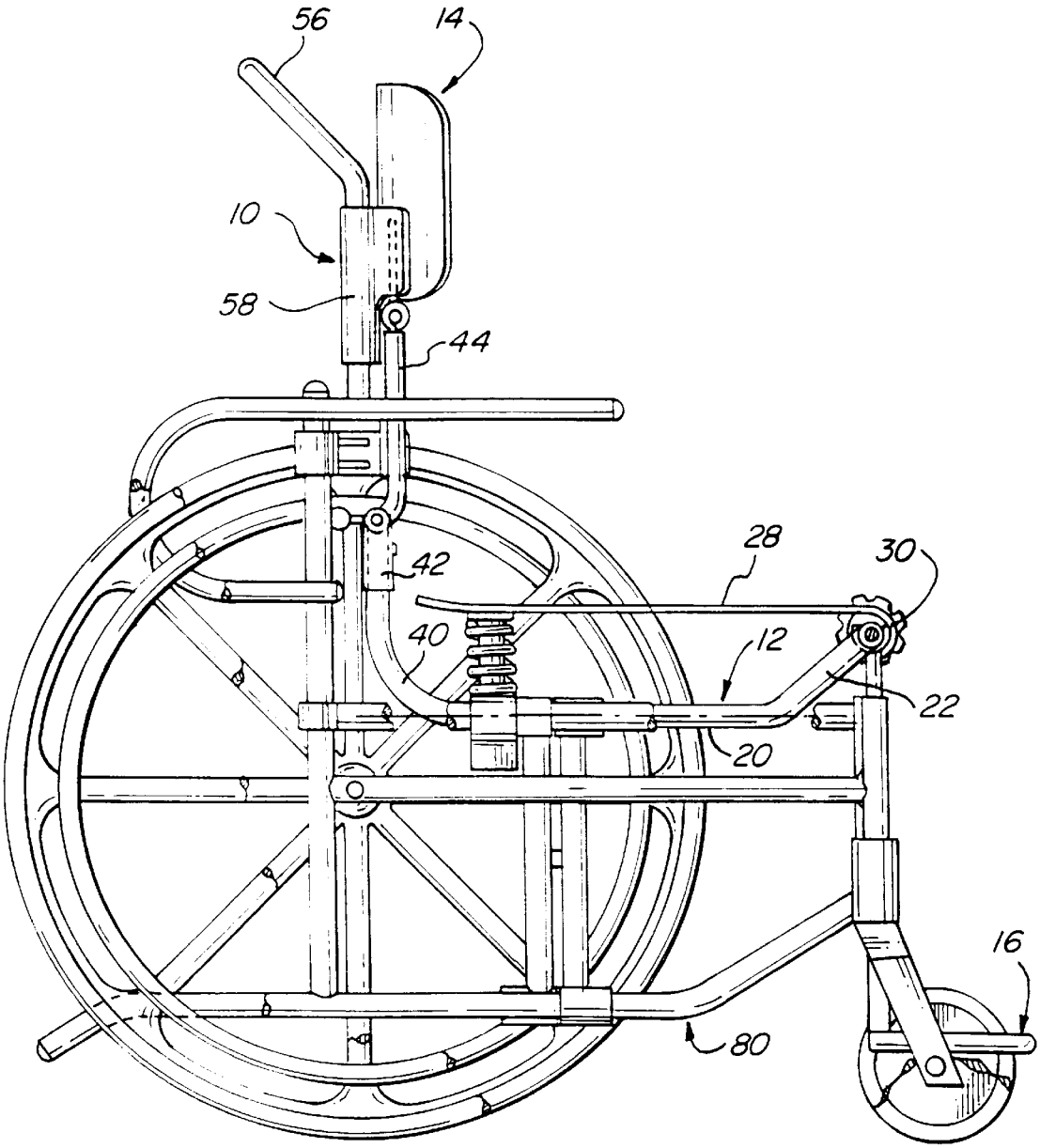
FIG. 6 is a side elevational view, partially cut away, of the wheelchair of FIG. 5.
Figure 7:
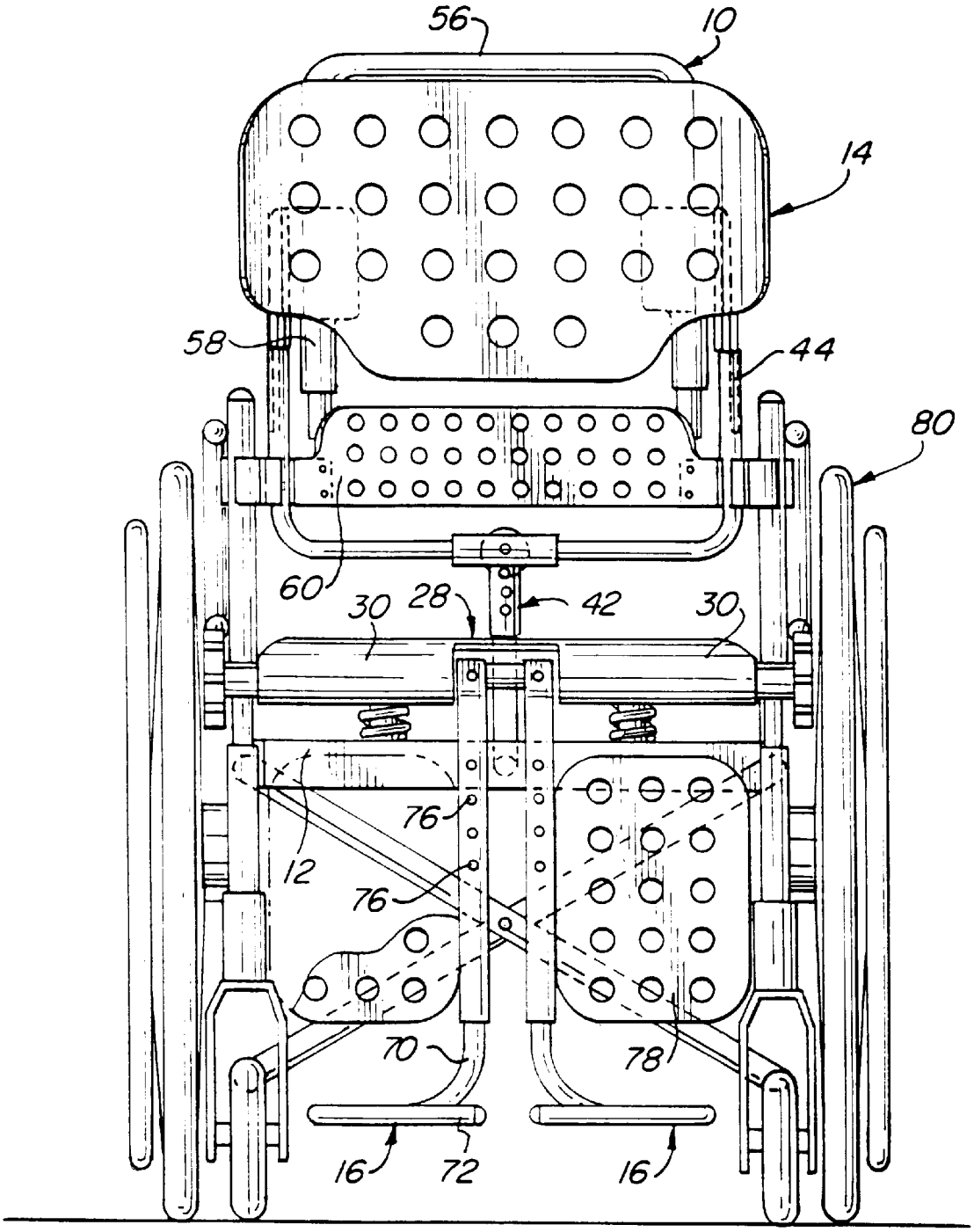
FIG. 7 is a front elevational, partially cut away, view of the wheelchair of FIG. 5.

The backrest subassembly 14 includes a backrest frame 44 having a tubular generally horizontal portion with two upwardly extending arms. The tubular horizontal portion of the backrest frame 44 fits within the hollow channel of the tee-shaped member 42 such that the backrest frame 44 may pivot about a transverse horizontal axis 46. Mounted on the tee-shaped member 42 is a backrest locking mechanism 48, preferably a spring-loaded pin. Backrest frame 44 has a hole (not shown) passing through a wall thereof in a position corresponding to the backrest locking mechanism 48 such that the backrest subassembly 14 may be locked in a substantially vertical position (as shown in FIG. 1A). When the backrest locking mechanism 48 is disengaged, the backrest subassembly 14 may be folded down to a position substantially parallel to the seat 28 (as shown in FIG. 4) to facilitate transport of the seat assembly 10.

The backrest subassembly 14 also includes two resilient pivotal members 50 attached to the upwardly extending arms of the backrest frame 44. A torsion spring or a spring-loaded hinge is preferred, although many known alternatives exist. A spring-loaded hinge manufactured by Com, Spa, an Italian manufacturer, was found to be particularly well-suited. A backrest 52 is connected to the resilient pivotal members 50 such that the backrest 52 is capable of resilient pivotal flexing about a transverse horizontal axis 54 when pressure is applied (as shown in phantom in FIG. 1B). The resilient pivotal member 50 preferably allows flexing of the backrest 52 of up to approximately 30 degrees from the normal vertical position, so that the center of gravity of the user remains over the wheels when a wheelchair chassis is used to prevent tipping of the chair.

A pushbar 56 is attached to the backrest 52 by two mounting brackets 58. A lower back support 60 is attached to the backrest frame 44. Preferably the backrest 52 and lower back support 60 are formed of a rigid material, such as a molded composite material, have a contoured shape ergonomically designed to correspond to the human body, and have a plurality of holes passing therethrough for ventilation. Also preferably, a backrest pad (not shown) constructed from a ventilated cushioning material is disposed on said backrest 52 and lower back support 60.

Mounted on the backrest subassembly 14 are two attachment mechanisms 62 for connecting the backrest subassembly 14 to a chassis (not shown). The attachment mechanisms 62 are preferably typical j-hooks (shown in FIG. 3) or E-Z MOUNTS connectors manufactured by Adaptive Equipment Systems, both of which can be locked onto a tubular portion of the chassis. When E-Z MOUNTS connectors are used, adjustment in the depth of the backrest 52 is possible.

The leg rests 16 each include a hollow tubular outer shaft 64 having a channel running therethrough attached at one end to a generally tubular connecting member 66 having a channel running therethrough perpendicular to the channel of the outer shaft 64. It should be noted that there are two leg rests 16, although the configuration of only one is discussed here for clarity. The outer shaft 64 is pivotally connected to the seat frame 12 by disposing the tubular crosspiece 24 through the hollow channel in the connecting member 66. The leg rests 16 are thus pivotal about the same transverse horizontal axis 34 as is the seat 28. Mounted within the tubular crosspiece 24 is a spring loaded pin 68. The connecting member 66 has a series of corresponding holes (not shown) spaced about its perimeter which correspond to the spring loaded pin 68 such that the leg rests 16 may be locked at various angles relative to the seat frame 12. The leg rests 16 may be pivoted back so as to be located under the seat 28 (shown in phantom in FIG. 1B). It should be understood that located under the seat 28 means that substantially no part of the leg rest 16 extends out beyond the four planes defined by the four sides of the seat 28 such that the leg rests do not interfere with a user being transferred to or from the seat assembly 10 or, in the case the seat assembly 10 is disposed within a wheelchair chassis, with the user propelling the wheelchair with his/her feet. Preferably, the leg rests 16 may be pivoted all the way back to a position substantially parallel to the seat 28 (shown in FIG. 4) to facilitate transport of the seat assembly 10.

The leg rests 16 also include a tubular inner shaft 70 disposed within the hollow channel of the outer shaft 64 in a telescoping arrangement. At an end of the inner shaft 70 is a footrest 72. The footrest 72 may be a separate member attached to the inner shaft 70, or may consist of a bent portion of the inner shaft 70. Preferably, the footrests are covered with a rubberized material for traction. Disposed within the inner shaft 70 is a spring loaded pin 74. The spring loaded pin 74 passes through a corresponding hole 76 in the outer shaft 64 such that the inner shaft 70 is locked into place relative to the outer shaft 64. By providing a series of spaced apart holes 76 in the outer shaft 64, the inner shaft 70 may be telescoped to various positions relative to the outer shaft 64 to provide adjustment in the length of the leg rests 16.

Also attached to the outer shaft 64 of the leg rests 16 is a calf rest 78 to support the calf of a user seated in the seat assembly 10. Preferably, the calf rest 78 is formed of a rigid material, such as a molded composite material, have a contoured shape ergonomically designed to correspond to the human body, and have a plurality of holes passing therethrough for ventilation and to aesthetically conform to the seat 28, backrest 52 and lower back support 60.

Figure 8:
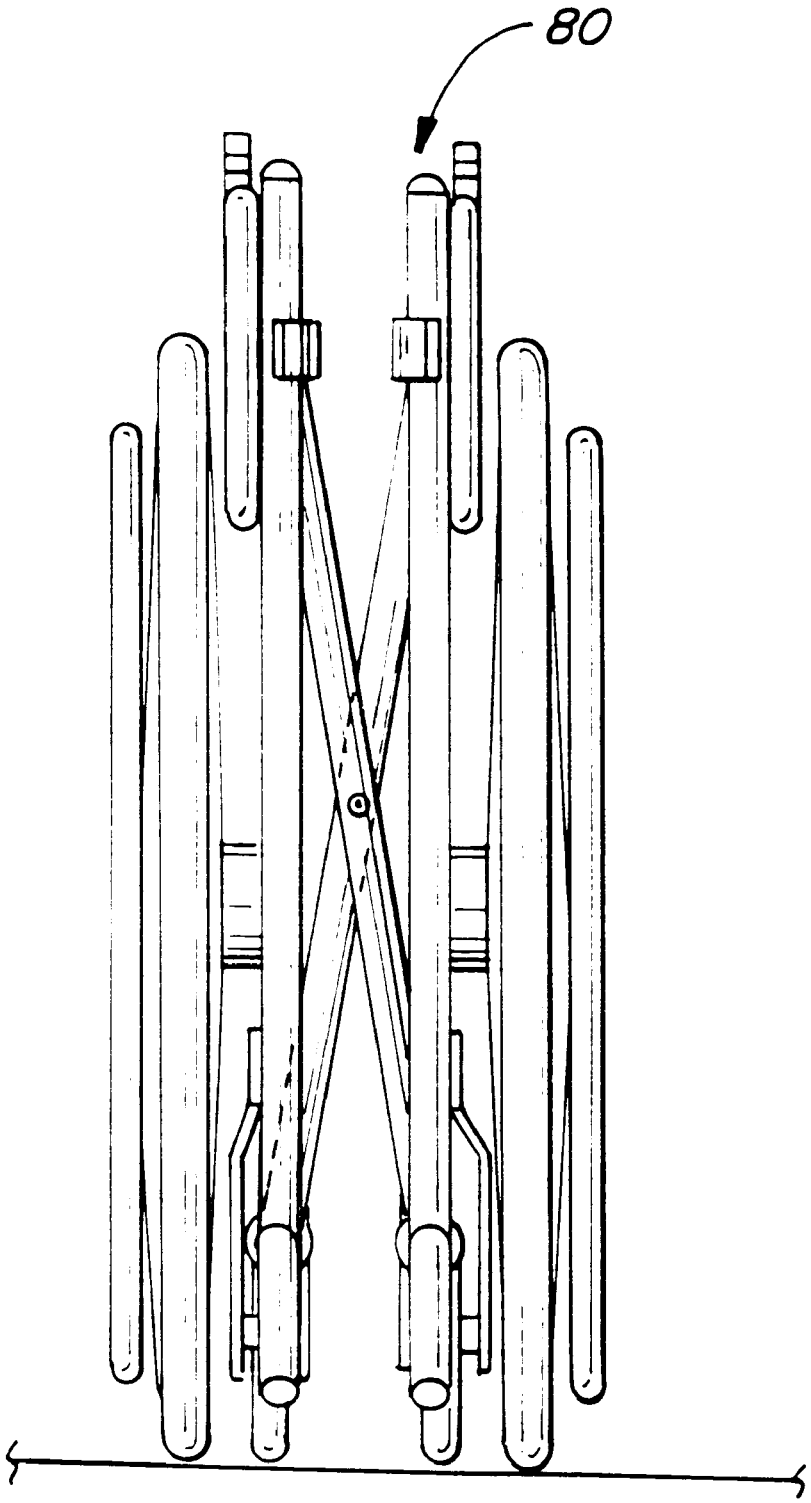
FIG. 8 is a rear elevational view of the wheelchair chassis of FIG. 5 shown in a folded position.

Referring now to FIGS. 5 through 8, the seat assembly 10 may be disposed within a wheelchair chassis 80. Collapsible, portable wheelchair chassis are known in the art. To use the seat assembly 10 with a chassis 80, the seat assembly 10 is disposed within the chassis, and the attachment mechanisms 38, 62 are locked into place on corresponding tubular portions of the chassis 80. FIG. 8 shows a typical wheelchair chassis 80 in a folded position to facilitate transport thereof.

Although a preferred embodiment of the present invention discloses a wheelchair comprising a seat assembly 10 and a wheelchair chassis 80, it should be noted that the seat assembly 10 is not limited to use in a wheelchair. The seat assembly may be attached to numerous other chassis types, such as one in a car, a theater, a stadium, or almost any other place a person may be seated.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An ergonomically designed seat assembly comprising:

a seat frame;

a seat pivotally connected to said seat frame such that said seat is capable of pivotal tilting about a transverse horizontal axis relative to said seat frame and independent of said backrest subassembly;

at least one resilient member disposed between said seat frame and said seat so as to allow resilient relative pivotal tilting therebetween; and, a backrest subassembly connected to a back support member which is mounted to the seat frame, said backrest subassembly comprising a backrest frame, at least one resilient pivotal member connected to said backrest frame, and a backrest connected to said at least one resilient pivotal member such that said backrest is capable of resilient pivotal flexing about a transverse horizontal axis, and wherein said back support member is slidably mounted within a hole in said seat frame such that the depth of said backrest relative to said seat is adjustable, and wherein said back support member comprises at least two portions in a telescoping relationship such that the height of said backrest relative to said seat is adjustable.

2. An ergonomically designed seat assembly comprising:

a seat frame;

a backrest subassembly connected to said seat frame, said backrest subassembly comprising a backrest frame, at least one resilient pivotal member connected to said backrest frame, and a backrest connected to said at least one resilient pivotal member such that said backrest is capable of resilient pivotal flexing about a transverse horizontal axis, and wherein said backrest subassembly is connected to a back support member which is slidably mounted within a hole in said seat frame such that the depth of said backrest relative to said seat is adjustable, and wherein said back support member comprises at least two portions in a telescoping relationship such that the height of said backrest relative to said seat is adjustable;

a seat pivotally connected to said seat frame such that said seat is capable of pivotal tilting about a transverse horizontal axis relative to said seat frame and independent of said backrest subassembly;

at least one resilient member disposed between said seat frame and said seat so as to allow resilient relative pivotal tilting therebetween;

two leg rests pivotally connected to said seat frame such that said leg rests are capable of pivoting about a transverse horizontal axis relative to said seat frame, said leg rests having a locking mechanism whereby said leg rests may be held in place at various angles relative to said seat frame.

3. A portable wheelchair comprising:

a collapsible wheelchair chassis;

a seat frame detachably connected to said wheelchair chassis;

a seat pivotally connected to said seat frame such that said seat is capable of pivotal tilting about a transverse horizontal axis relative to said seat frame and independent of said backrest subassembly;

at least one resilient member disposed between said seat frame and said seat so as to allow resilient relative pivotal tilting therebetween; and, a backrest subassembly adjustably connected to said seat frame and detachably connected to said wheelchair chassis, said backrest subassembly comprising a backrest frame, at least one resilient pivotal member connected to said backrest frame, and a backrest connected to said at least one resilient pivotal member such that said backrest is capable of resilient pivotal flexing about a transverse horizontal axis.

4. The portable wheelchair of claim 3 further comprising a backrest locking mechanism connected to said seat frame, and wherein said backrest subassembly is pivotally connected to said seat frame such that said backrest assembly is capable of pivoting about a transverse axis relative to said seat frame and is capable of being locked in an upright position by said backrest locking mechanism.

5. The portable wheelchair of claim 3 wherein said backrest subassembly is capable of being pivoted such that said backrest is substantially parallel to said seat.

6. The portable wheelchair of claim 3 wherein said backrest subassembly is connected to a back support member which is slidably mounted within a hole in said seat frame such that the depth of said backrest relative to said seat is adjustable, and wherein said back support member comprises at least two portions in a telescoping relationship such that the height of said backrest relative to said seat is adjustable.

7. The portable wheelchair of claim 3 wherein said backrest subassembly further comprises a pushbar connected to said backrest.

8. The portable wheelchair of claim 3 wherein said seat and said backrest are formed from a rigid material, have a contoured shape ergonomically designed to correspond to the human body, and have a plurality of holes passing therethrough for ventilation.

9. The portable wheelchair of claim 3 further comprising two leg rests pivotally connected to said seat frame such that said leg rests are capable of pivoting about a transverse horizontal axis relative to said seat frame, said leg rests having a locking mechanism whereby said leg rests may be held in place at various angles relative to said seat frame.

10. The portable wheelchair of claim 9 wherein said leg rests are capable of pivoting such that said leg rests can be located under said seat.

* * * * *